US009149093B2

(12) United States Patent
Leger et al.

(10) Patent No.: US 9,149,093 B2
(45) Date of Patent: Oct. 6, 2015

(54) EXTENSIBLE CLASP FOR A BRACELET, IN PARTICULAR A WATCHSTRAP

(75) Inventors: Georges Leger, Marignier (FR); Arnaud Girardot, Veyrier du Lac (FR)

(73) Assignee: THI TECHNOLOGIES HORLOGERE INDUSTRIELLE S.A., Satigny (CH)

( * ) Notice: Subject to any disclaimer, the term of this patent is extended or adjusted under 35 U.S.C. 154(b) by 274 days.

(21) Appl. No.: 13/504,365

(22) PCT Filed: Oct. 8, 2010

(86) PCT No.: PCT/IB2010/002550

§ 371 (c)(1), (2), (4) Date: Jun. 4, 2012

(87) PCT Pub. No.: WO2011/051768

PCT Pub. Date: May 5, 2011

(65) Prior Publication Data

US 2012/0240361 A1 Sep. 27, 2012

(30) Foreign Application Priority Data

Oct. 26, 2009 (CH) ..... 1629/09

(51) Int. Cl.
*A44C 5/24* (2006.01)

(52) U.S. Cl.
CPC ..... *A44C 5/246* (2013.01); *Y10T 24/4745* (2015.01); *Y10T 24/4782* (2015.01)

(58) Field of Classification Search
CPC ..... A44C 5/246; A44C 5/185; A44C 5/2052; A44C 5/24; A44C 5/22; Y10T 24/2155; Y10T 24/2115; Y10T 24/4782; Y10T 24/2106; Y10T 24/2143; Y10T 24/216; Y10T 24/2166; Y10T 24/4745; A43C 11/146
USPC ..... 24/68 J, 71 J, 71 R, 265 EC, 265 WS, 24/265 R, 265 B, 483, 484
See application file for complete search history.

(56) References Cited

U.S. PATENT DOCUMENTS 1,985,835 A * 12/1934 Prestinari ..... 24/71 J
2,499,102 A * 2/1950 Levine ..... 24/71 R (Continued)

FOREIGN PATENT DOCUMENTS

EP 1378185 1/2004
EP 1716776 11/2006

(Continued)

OTHER PUBLICATIONS

International Search Report for PCT/IB2010/002550, English translation attached to original, Both completed by the European Patent Office on Jan. 5, 2011, All together 5 Pages.

*Primary Examiner* — Robert J Sandy
*Assistant Examiner* — David Upchurch
(74) *Attorney, Agent, or Firm* — Brooks Kushman P.C.

(57) ABSTRACT

A clasp for a bracelet enabling the bracelet length to be adjusted with the clasp closed. The clasp has first and second leaves pivotably connected relative to one another at a first end. A cover pivotably connects a second end of the first leaf to be connected to a first strand of the bracelet. A mobile tip is arranged on a second end of the second leaf to connect to a second strand of the bracelet. The clasp has an indexing mechanism for adjusting the length of the bracelet and a release arranged such as to enable the mobile tip to move from one indexed position to another. The second leaf ends in two rectilinear rails along which the mobile tip can slide. The indexing mechanism is located on a rail of the second leaf while the release mechanism is arranged to move together with the mobile tip.

12 Claims, 2 Drawing Sheets

(56) References Cited

U.S. PATENT DOCUMENTS

Figure 1:
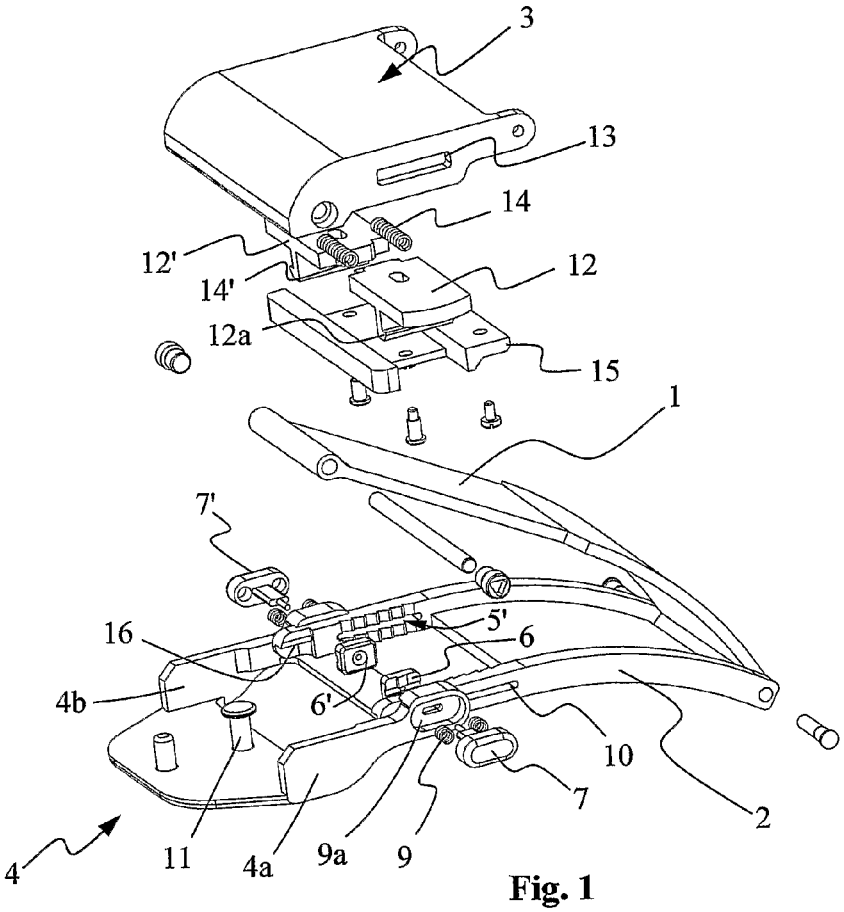

| | | | | |
|---|---|---|---|---|
| 4,330,905 | A * | 5/1982 | Wolfgang | 24/71 J |
| 4,542,561 | A * | 9/1985 | Hysek | 24/71 R |
| 4,545,094 | A * | 10/1985 | Fontana | 24/71 J |
| 5,669,122 | A * | 9/1997 | Benoit | 24/71 SK |
| 5,927,577 | A | 7/1999 | Braun | |
| 6,944,916 | B2 | 9/2005 | Kawagoe | |
| 7,289,310 | B1 | 10/2007 | Yuan | |
| 7,571,519 | B2 * | 8/2009 | Sierro | 24/71 J |
| 7,926,150 | B2 * | 4/2011 | Robert et al. | 24/71 J |
| 8,001,658 | B2 * | 8/2011 | Christian et al. | 24/71 J |
| 2004/0083581 | A1 * | 5/2004 | Kawagoe | 24/265 WS |
| 2007/0125123 | A1 * | 6/2007 | Sierro | 63/3.2 |

FOREIGN PATENT DOCUMENTS

| | | |
|---|---|---|
| EP | 1920673 | 5/2008 |
| EP | 1943917 | 7/2008 |
| JP | 59108411 | 7/1984 |
| WO | 2008064931 | 6/2008 |

* cited by examiner

EXTENSIBLE CLASP FOR A BRACELET, IN PARTICULAR A WATCHSTRAP

CROSS-REFERENCE TO RELATED APPLICATION

This application is the U.S. national phase of PCT Appln. No. PCT/IB2010/002550 filed on Oct. 8, 2010, which claims priority to CH Patent Application No. 01629/09 filed on Oct. 26, 2009, the disclosures of which are incorporated in their entirety by reference herein.

The present invention relates to the field of bracelets, notably for watches. It relates more particularly to a bracelet clasp with an unfolding buckle allowing the length of the bracelet to be precisely adjusted.

Clasps with unfolding buckles are well known for their esthetic appearance. These clasps are often associated with bracelets made up of links. The length of the bracelet is usually adjusted in this case at the retailer by the addition or removal of one or more links depending on the size of the wearer's wrist. This adjustment is usually final and does not take account of the differences of the periphery of the wrist depending on the ambient heat and/or depending of the efforts made by the wearer. However, it is found that the need to make such an adjustment is often felt because the dimensions of the wrist change depending on whether the ambient temperature is low or high. Without possible adjustment, the bracelet may constrict the wrist at the high temperatures of the summer. Conversely, in winter, this same bracelet tends to rotate around the wrist.

There are several watch bracelets furnished with a system allowing the wearer of the watch to adjust the length of the bracelet himself by a few millimeters only according to the circumstances. Such clasps are described notably in publications U.S. Pat. No. 5,927,577, JP 59108411, EP 1716776, EP 1378185, EP 1943917, EP1920673 or else WO 2008/064931.

As an example, the device disclosed in publication U.S. Pat. No. 5,927,577 comprises an end-piece of which one of the ends is articulated at one end of one of the strands of the bracelet, the other end of the end-piece being fitted with a rod capable of being positioned inside a lid in various orifices arranged along the lateral sides of the latter. The major drawback of this device arises from the fact that it is necessary to open the clasp to adjust the length of the bracelet.

JP 59108411 relates to a clasp for an unfolding buckle with two leaves comprising a first and a second leaf articulated relative to one another at a first end and a cover articulated at a second end of the first leaf, the cover being connected to a first strand of the bracelet. A substantially rectangular opening extends along the longitudinal axis of the second leaf. The longitudinal sides of this opening are provided with a notched portion arranged to interact with locking means, which are secured to a support of the unfolding buckle, the support being connected to a second strand of the bracelet. The locking means comprise two locking elements designed to be positioned in one of the notches of each notched portion of the opening of the second leaf in order to lock the latter relative to the leaf support in a desired indexed position. The locking means also comprise a button the actuation of which makes it possible to release each locking element from the corresponding notched portion in order to be able to adjust the length of the bracelet. Each locking element is then positioned in another of the notches of one and the other of the notched portions when the button is no longer actuated in order to lock the second leaf relative to the leaf support in another indexed position. Like publication U.S. Pat. No. 5,927,577, it is necessary to open the clasp to adjust the length of the bracelet, which complicates handling.

EP 1716776 discloses a device for adjusting the length of a bracelet that is designed to remedy notably the abovementioned problem. This device comprises a lid inside which an end-piece articulated at one end of the bracelet is capable of sliding. This end-piece comprises means for prepositioning and for locking in position that interact with a releasing system allowing the length of the bracelet to be adjusted without being forced to open said bracelet. According to the teaching of EP 1716776, this adjusting device is designed to be mounted on rigid bracelets with links in which the ends are attached to a clasp with unfoldable articulated leaves. This device is therefore not suitable for bracelets made of leather or of another flexible material in which one of the strands is designed to be arranged in a slide-through assembly provided with a tongue for a rough adjustment of the bracelet length.

Publication EP 1378185 proposes a clasp with an unfolding buckle with two leaves that resolves the above-mentioned problems. The two leaves of this clasp are articulated relative to one another at one of their ends while the other of their ends is connected respectively to a cover connected to one of the strands of a bracelet and to a movable end-piece connected to the other of the bracelet strands. The movable end-piece is arranged inside a receptacle inside which indexing means are installed for adjusting the length of the bracelet. These indexing means comprise two locking elements arranged to interact each with a notched portion in the form of sawteeth situated along the internal lateral walls of the receptacle. Two buttons placed on the external lateral walls of the receptacle make it possible, when they are actuated, to release the locking elements from the notched portions in order to be able to adjust the length of the bracelet.

The object of the present invention is to propose a different version of an extensible clasp for a bracelet which has the advantage of providing precise adjustment of the length of the bracelet when the clasp is in the closed position and which can be easily adapted to be mounted on a link bracelet or a bracelet made of leather.

According to the invention, this object is achieved by virtue of a clasp with an unfolding buckle for a bracelet allowing adjustment of the length of the bracelet when the clasp is in the closed position. For this purpose, the clasp comprises: a first and a second leaf that are articulated relative to one another at a first end; a cover articulated at a second end of the first leaf and arranged to be connected to a first strand of the bracelet; a movable end-piece arranged at a second end of the second leaf in order to be connected to a second strand of the bracelet; indexing means for adjusting the length of the bracelet, and releasing means arranged to allow a movement of the movable end-piece from one indexed position to another. The second leaf terminates in two rectilinear rails along which the movable end-piece is capable of sliding. The indexing means are situated on at least one of the rails of the second leaf while the releasing means are arranged so as to move with the movable end-piece from one indexed position to another.

The features of this clasp allow an immediate, comfortable and precise length adjustment while bene-fitting from a simple, esthetic and reliable construction.

Moreover, the movable end-piece may advantageously consist of a slide-through assembly provided with a tongue in order to receive one of the strands of a bracelet made of leather or of another flexible material or form per se one of the links of a link bracelet.

Figure 2:
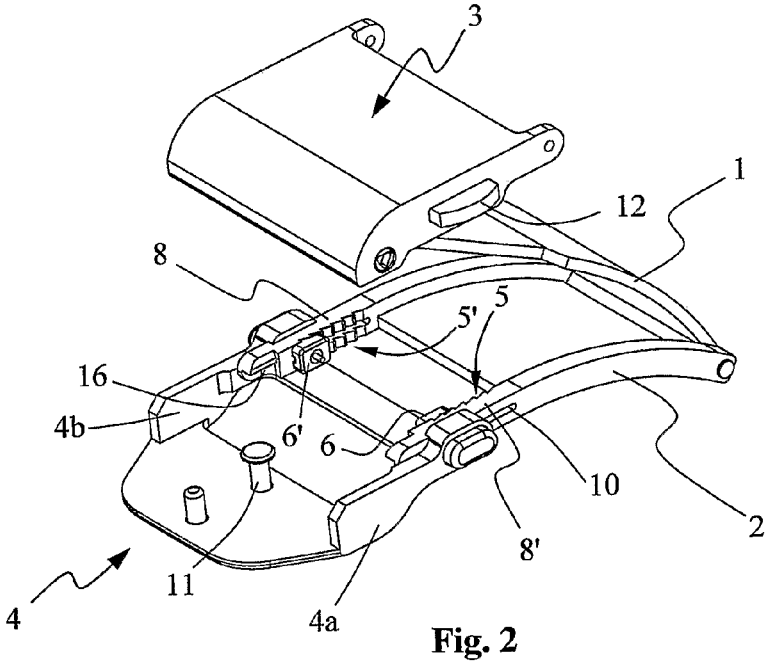
Figure 3:
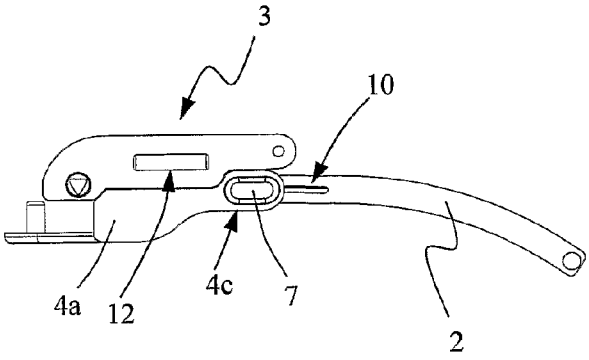
Figure 4:
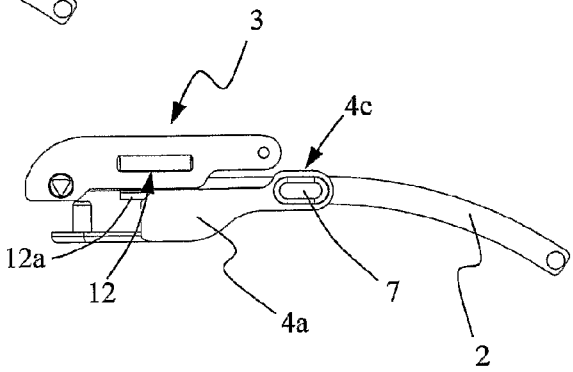
Figure 5:
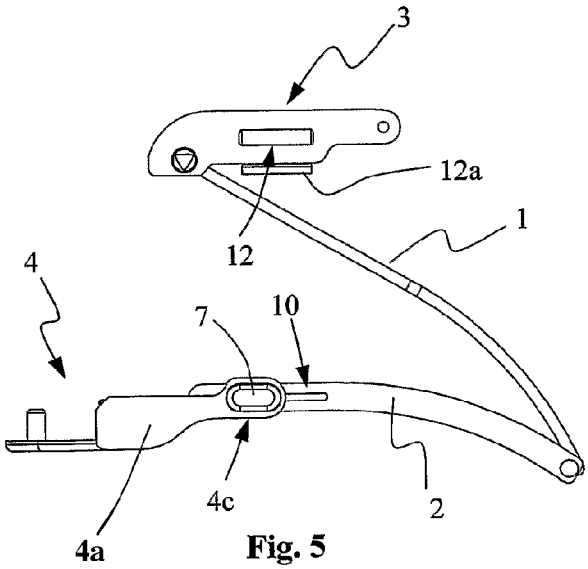

The features of the invention will be more clearly evident on reading a description of a preferred embodiment, given only as an example and in no way limiting, by referring to the schematic figures in which:

FIG. 1 represents an exploded view of the clasp with unfolding buckle for a watch bracelet according to the preferred embodiment of the invention, FIG. 2 represents a view in perspective of the clasp of FIG. 1 assembled, FIG. 3 represents a side view of the latched clasp in which the movable end-piece is in a first indexed position, FIG. 4 represents a side view of the latched clasp in which the movable end-piece is in a second indexed position, FIG. 5 represents a side view of the clasp in a position in which the leaves are partially unfolded.

According to the preferred embodiment of the invention as illustrated by FIGS. 1 to 5, the clasp with unfolding buckle comprises a first and a second leaf 1, 2 that are articulated relative to one another at a first end. A cover 3 is, for its part, articulated at a second end of the first leaf 1 and is arranged to be connected to a first strand of the bracelet. The second end of the second leaf 2 terminates in two rectilinear rails 8, 8' (FIG. 2) which are arranged in the extension of the lateral sides of said second leaf. With reference notably to FIG. 2, a movable end-piece 4 designed to be connected to a second strand of the bracelet, comprises two lateral sides 4*a*, 4*b* each comprising a flange 4*c* which is held against one and the other of the external lateral sides of the two rails 8, 8' of the second leaf 2. Each flange 4*c* of the movable end-piece 4 is capable of sliding along the corresponding rail 8, 8'.

Indexing means 5, 5', 6, 6' for adjusting the length of the bracelet and releasing means 7, 7' are arranged to allow the movable end-piece 4 to move from one indexed position to another. The indexing means 5, 5', 6 and 6' comprise a notched portion 5, 5' (FIGS. 1 and 2) arranged along the internal lateral side of each of the two rails 8, 8' and two locking elements 6, 6' secured to the movable end-piece 4. Each locking element 6, 6' is secured to return means 9 in order to be held against the notched portion 5, 5' of each rectilinear rail 8, 8' in an indexed position. Said notched portion 5, 5' preferably has a sawtooth profile while a tooth of matching shape is cut into the face of the locking elements 6, 6' designed to interact with the appropriate notched portion 5, 5'. A position is indexed when each tooth of these two locking elements 6, 6' is inserted into one of the notches of each notched portion 5, 5' under the action of the return means 9.

According to FIG. 1, the releasing means comprise two buttons 7, 7' each arranged inside a housing 9*a* situated on the flanges 4*c* of the movable element 4. The two rectilinear rails 8, 8' of the second leaf 2 are each provided with a rectilinear slot 10 traversed by one and the other of the buttons 7, 7' so that each button is connected to the corresponding locking element 6, 6'. A simultaneous pressure on the two buttons 7, 7' of the movable end-piece 4 makes it possible to move each locking element 6, 6' in a direction perpendicular to the longitudinal axis of the rails 8, 8'. At this moment, the tooth of each locking element 6, 6' is released from the corresponding notched portion 5, 5' and the movable element 4 is again separated from the two rails 8, 8'. It can then freely slide along these rails 8, 8' from one indexed position to another while each button 7, 7' slides along the rectilinear slot 10. The return means 9 make it possible to reengage the locking element 6, 6' in the desired indexed position when the buttons are no longer operated.

Note that the orientation of the sawtooth toothed element makes it possible to reduce the length of the bracelet without having to actuate the two buttons 7, 7'. It is sufficient to apply a force along the longitudinal axis of the bracelet in order to overcome the force exerted by the return means 9 on the locking elements 6, 6'. In this embodiment, the return means consist of two coil springs 9 arranged on either side of the body of each button 7, 7' in the housing 9*a* of each flange 4*c*.

In this embodiment, the movable end-piece 4 is a slide-through assembly provided with a tongue 11 designed to be inserted into one of the holes of one of the strands of the bracelet. In a variant not illustrated, the end-piece 4 is configured so as to constitute a first link of one of the strands of a link bracelet.

According to FIG. 1, two additional buttons 12, 12' are arranged facing one another beneath the cover 3 so that they protrude through a rectangular opening 13 situated on the lateral walls of the cover 3. Two coil springs 14, 14' are mounted between the two buttons 12, 12' so that the latter are subjected to a return force. A guide element 15 is screwed under the cover 3 in order to keep the buttons 12, 12' and the springs 14, 14' confined in the cover 3, the shape of the guide element 15 being defined in order to allow a rectilinear movement of the buttons 12, 12' when they are actuated. Each button 12, 12' has a rectangular portion which is oriented in a plane perpendicular to the rectilinear movement of the button beneath the latter, its end 12*a* being curved in order to be positioned in a recess 16 situated at the ends of the two rails 8, 8' on their bottom portion. Moreover, the bottom portion of each curved portion comprises a bevel at 45° relative to a horizontal plane so that the clasp can be closed simply by pressing on the cover 3. More precisely, when each bevel is in contact with the top portion of each end of the two rails 8, 8' and a pressure is applied to the cover 3, the result is a lateral movement of each curved portion 12*a* in order to bring the latter level with each recess 16. Each curved portion 12*a* is then moved, under the action of the springs 14, 14', up against their respective recess 16, the top portion of the rails 8, 8' serving as a stop thus latching the clasp. For its part, the opening of the clasp occurs when a simultaneous pressure is applied to the two buttons, 12, 12'.

The indexing means 5, 5', 6, 6' could be arranged not along the internal lateral side of the two rails 8, 8' but on their top or bottom side. In this configuration, the locking element 6, 6' would be arranged to be able to slide along the top or bottom portion of the rails 8, 8'.

Finally, this clasp for a bracelet is specially adapted for use in relation to watches, but it could equally be used for any other object worn on the wrist.

The invention claimed is:

1. A clasp with an unfolding buckle for a bracelet allowing adjustment of the length of the bracelet when the clasp is in the closed position, said clasp comprising:

a first and a second leaf that are articulated relative to one another at a first end, a cover having a first end, a second end, and an exterior surface which overlies a portion of the first and second leafs when in the closed position, the first end of the cover being articulated at a second end of the first leaf and the second end arranged to be connected to a first strand of the bracelet, a movable end-piece arranged at a second end of the second leaf in order to be connected to a second strand of the bracelet, an indexing means cooperating with the movable end-piece for adjusting the length of the bracelet, a releasing means arranged to allow a movement of the movable end-piece from one indexed position to another, characterized in that the second leaf terminates in two rectilinear rails which are located adjacent to the second end of the second leaf and along which the movable end-piece is capable of sliding, the movable end-piece comprises a first end part that is slidable along said rails adjacent to the second end of the second leaf and a second end part that protrudes from the second end of the second leaf, the indexing means are situated on at least one of the rails of the second leaf, the releasing means are arranged so as to move with the movable end-piece, and when the clasp is in the closed position, the cover and the second end of the first leaf overlie said second end part of the movable end-piece that protrudes from the second end of the second leaf.

2. The clasp as claimed in claim 1, wherein the two rectilinear rails having internal and external lateral sides are arranged along the sides of the second leaf substantially from an articulation point of the first and second leafs to the movable end-piece.

3. The clasp as claimed in claim 1, wherein the rails have internal and external sides relative to the second leaf, the movable end-piece comprises two lateral sides each comprising a flange which is held against one and the other of the external lateral sides of the two rails of the second leaf, each flange of the movable end-piece being capable of sliding along the corresponding rail.

4. The clasp as claimed in claim 3, wherein the indexing means comprise a notched portion arranged along the two rails, the indexing means also comprising at least one locking element secured to the movable end-piece, the locking element being subjected to return means in order to be held against the notched portion of the rail in an indexed position, the locking element being disengaged from the notched portion of the rail in order to allow the movable end-piece to move along the two rails from one indexed position to another when the length of the bracelet is adjusted.

5. The clasp as claimed in claim 4, wherein the notched portion of the rail or rails is a toothed element made of sawteeth while a face of the locking element designed to interact with the notched portion comprises a tooth of matching shape, the toothed element made of sawteeth of the notched portion being oriented so that the length of the bracelet can be reduced without having to actuate the releasing means.

6. The clasp as claimed in claim 4, wherein the indexing means comprise a first and a second notched portion arranged respectively along the internal lateral side of one and the other of the two rails, and two locking elements arranged to interact each with the respective notched portion of the corresponding rail.

7. The clasp as claimed in claim 4, wherein the releasing means comprise a first and a second button each arranged on the flange respectively of one and the other of the lateral sides of the movable end-piece, each button being connected to the corresponding locking element, and in that a slot is arranged along each rail of the second leaf so that each button can slide along the respective slot when the length of the bracelet is adjusted.

8. The clasp as claimed in claim 1, wherein the cover has means for latching the clasp comprising two additional buttons having bottoms and arranged on the sides of the cover, a curved portion being connected to the bottom of each button, each curved portion being designed to be positioned beneath a corresponding portion arranged at an end of each rail.

9. The clasp as claimed in claim 1, wherein the movable end-piece is a slide-through assembly comprising a tongue designed to be inserted into one of a set of holes in one of the strands of the bracelet.

10. The clasp as claimed in claim 1, wherein the movable end-piece forms a first link of one of the strands of the bracelet.

11. A bracelet comprising the clasp as claimed in claim 1.

12. A watch comprising the bracelet as claimed in claim 11.

* * * * *